United States Patent [19]

Nakamura et al.

[11] Patent Number: 4,544,349

[45] Date of Patent: Oct. 1, 1985

[54] OIL BURNER COMPRISING SAFEGUARD MECHANISM AGAINST POWER STOPPAGE

[75] Inventors: Kazuharu Nakamura; Motoki Matsumoto, both of Aichi, Japan

[73] Assignee: Toyotomi Kogyo Co., Ltd., Aichi, Japan

[21] Appl. No.: 434,449

[22] Filed: Oct. 15, 1982

[30] Foreign Application Priority Data

Oct. 16, 1981 [JP] Japan ..... 56-166251

[51] Int. Cl.[4] ..... F23D 5/02

[52] U.S. Cl. ..... 431/258; 431/30; 431/90

[58] Field of Search ..... 431/258, 30, 90

[56] References Cited

U.S. PATENT DOCUMENTS

| | | | |
|---|---|---|---|
| 1,782,668 | 11/1930 | Stuart | 431/30 |
| 1,853,345 | 4/1932 | Frame | 431/30 |
| 2,100,673 | 11/1937 | Schwander et al. | 431/90 |
| 2,255,318 | 9/1941 | Hawley | 431/30 |
| 2,267,187 | 12/1941 | Boch | 431/30 |
| 2,424,754 | 7/1947 | Heymann | 431/30 |
| 2,445,466 | 7/1948 | Arnhym | 431/90 |
| 3,236,282 | 2/1966 | Biermann et al. | 431/30 |
| 3,262,485 | 7/1966 | Page et al. | 431/90 |
| 3,299,940 | 1/1967 | Phillips et al. | 431/90 |
| 4,118,172 | 10/1978 | Noir et al. | 431/90 |

FOREIGN PATENT DOCUMENTS 42024 12/1972 Japan .

*Primary Examiner*—Samuel Scott
*Assistant Examiner*—H. A. Odar
*Attorney, Agent, or Firm*—Pollock, Vande Sande & Priddy

[57] ABSTRACT

An oil burner comprising a safeguard mechanism against a power stoppage is disclosed which is capable of carrying out a fire extinguishing operation in a complete combustion state upon a power stoppage, to thereby prevent any soot and smelly and toxic combustion product from being produced. The oil burner includes a solenoid valve mechanism having a wiring of allowing the supply of a fuel oil to an oil supply pipe to be stopped upon a power stoppage, an air damper actuated in cooperation with a mechanism for changing the flow rate of a fuel oil supplied to the oil supply pipe, a solenoid connected to the air damper which has a wiring of allowing the air damper to be opened upon a power stoppage, and an air fan rotated due to inertia force upon a power stoppage.

10 Claims, 4 Drawing Figures

OIL BURNER COMPRISING SAFEGUARD MECHANISM AGAINST POWER STOPPAGE

BACKGROUND OF THE INVENTION

1. Field of the Invention

This invention relates to an oil burner comprising a safeguard mechanism against a power stoppage, and more particularly to an oil burner capable of accomplishing a fire extinguishing operation in a perfect combustion state without causing any abnormal combustion upon a power stoppage, namely, an interruption of electrical service.

2. Description of the Prior Art

There has been conventionally known an oil burner which is adapted to vaporize a fuel oil by means of a vaporization means and to form a combustible gas from the vaporized fuel oil in the vaporization means using an air supplied thereto. In such conventional oil burner having a vaporization means, the vaporization means is not provided independent from a combustion means. This results in such conventional oil burner having an important disadvantage that it carries out an incomplete combustion to produce a large amount of soot and a smelly and/or toxic incomplete combustion product when the flow rate of an air supplied is varied due to, for example, the stop of an air fan. Such disadvantage remarkably appears when the supply of an electrical current to the oil burner is abruptly interrupted due to a power stoppage. Thus, the conventional oil burner of such type is not suitable for use in the interior. Recently, there has been proposed an oil burner of such type which is capable of carrying out a fire extinguishing operation in a complete combustion while the supply of an electrical current to the oil burner is being continued. However, even such oil burner is not constructed to carry out a fire extinguishing operation in a complete combustion state upon a power stoppage.

BRIEF SUMMARY OF THE INVENTION

The present invention has been made in view of the foregoing disadvantage in the prior art.

Accordingly, it is an object of the present invention to provide an oil burner comprising a safeguard mechanism against a power stoppage, which is capable of carrying out a fire extinguishing operation in a complete combustion state upon a power stoppage as well, so that it does not produce any soot and any smelly and toxic incomplete combustion product.

It is another object of the present invention to provide an oil burner comprising a safeguard mechanism against a power stoppage, which is capable of effectively stopping the supply of a fuel oil upon a power stoppage to more effectively accomplish the above-mentioned object.

It is a further object of the present invention to provide an oil burner comprising a safeguard mechanism against a power stoppage, which is capable of carrying out the above-mentioned objects with a simple construction.

In accordance with the present invention, there is provided an oil burner comprising a vaporization and ignition means having an air supply pipe and an oil supply pipe connected thereto which respectively supply to the vaporization and ignition means an air and a fuel oil necessary to form a combustible gas in the vaporization and ignition means; a mechanism for changing the flow rate of a fuel oil supplied to the oil supply pipe, the flow rate changing means being connected to the oil supply pipe; a solenoid valve mechanism connected to the oil supply pipe, the solenoid valve mechanism having a wiring which allows the supply of a fuel oil to the oil supply pipe to be stopped when the supply of an electric current to the oil burner is interrupted; an air damper means connected to the air supply pipe and actuated in cooperation with the flow rate changing mechanism; a solenoid means connected to the air damper means, the solenoid means having a wiring which allows the air damper means to be opened when the supply of an electric current to the oil burner is stopped; and an air fan connected to the air damper means, the air fan being rotated by inertia force when the supply of an electric current to the oil burner is interrupted.

According to a preferred embodiment of the present invention, an oil burner comprising a safeguard mechanism against a power stoppage further comprises a ramification pipe connected between the flow rate changing mechanism and the air supply pipe, the oil supply pipe being connected through the air supply pipe to the vaporization means, the air supply pipe being downwardly sloped between the portion thereof connected with the oil supply pipe and the end portion thereof connected to the vaporization means.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals designate the same parts throughout the figures thereof and wherein.

DETAILED DESCRIPTION OF THE PREFERRED EMBODIMENT

Now, an oil burner comprising a safeguard mechanism against a power stoppage according to the present invention will be described hereinafter with reference to the accompanying drawings.

Figure 1:
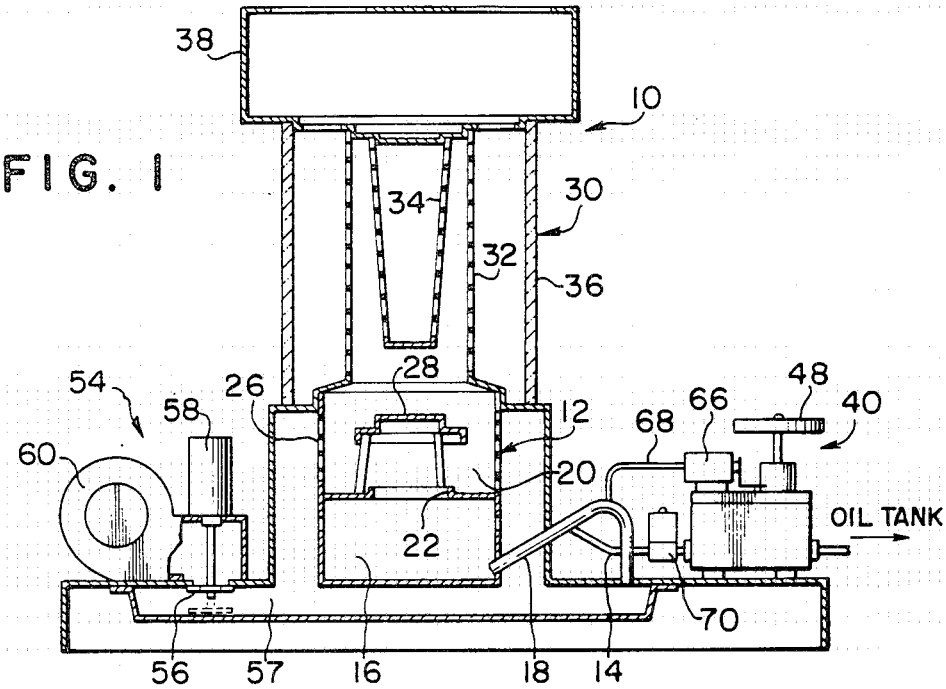
FIG. 1 is a vertical sectional view showing an embodiment of an oil burner comprising a safeguard mechanism against a power stoppage according to the present invention.

FIG. 1 illustrates an embodiment of an oil burner having a safeguard mechanism against a power stoppage incorporated therein according to the present invention wherein the oil burner is generally designated by reference numeral 10. The oil burner illustrated in FIG. 1 is a red-hot type oil space heater; however, it should be noted that the oil burner is not limited to such oil space heater.

The oil burner 10 shown in FIG. 1 is constructed in such a manner as shown in the art, except a safeguard mechanism against a power stoppage incorporated therein. The oil burner 10 includes a vaporization and ignition means 12 having a heater means (not shown) disposed therein, the heater acting to vaporize and ignite a fuel oil supplied to the means 12 through a fuel oil supply pipe 14 from a fuel oil storage tank (not shown). The vaporization and ignition means 12 has a vaporizing and igniting chamber 16 defined in a lower section thereof which is adapted to vaporize a fuel oil supplied thereto through the supply pipe 14 connected thereto, mix the vaporized fuel oil with an air supplied thereto through an air supply pipe 18 from an ambient atmosphere to form a combustible gas, and ignite the combustible gas by means of the heater. As illustrated, air supply pipe 18 slopes downwardly into chamber 16 and fuel supply pipe 14 empties into air supply pipe 18; so that, fuel and air flow downwardly into chamber 16 through the end portion of pipe 18 connected to chamber 16. The vaporization and ignition means 12 also has a flame diffusion chamber 20 defined in an upper section thereof and communicated through an opening 22 with the vaporizing and igniting chamber 16. Chamber 20 has a side wall provided with a plurality of through-holes 26 for supplying a combustion air from an ambient atmosphere therethrough to the chamber 20. The flame diffusion chamber 20 is provided therein a flame diffusion means 28 which allows the ignited combustible gas formed in the vaporizing and igniting chamber 16 and supplied to the chamber 20 through the opening 22 to be diffused and uniformly mixed with the combustion air supplied through the through-holes 26 in the chamber 20.

The oil burner 20 also includes a combustion chamber 20 disposed above the flame diffusion chamber 20 and communicated therewith, which is adapted to burn the ignited combustible gas supplied thereto from the flame diffusion chamber 20. The combustion chamber 30 has an outer perforated combustion cylinder 32 and an inner perforated combustion cylinder 34 each formed of a ceramic material. The combustible gas supplied to the combustion chamber 30 is burned on the outer surface of the inner cylinder 34 and the both surfaces of the outer cylinder 32 to red-heat the cylinder 32 and 34. Around the outer combustion cylinder 32 is disposed a transparent cylinder 36 formed of heat-resistant glass through which heat rays are discharged from the combustion chamber 30 to the exterior of the oil burner. Above the combustion chamber 30, an auxiliary combustion chamber 38 is disposed in communication therewith. The auxiliary combustion chamber 38 serves to completely burn a combustible gas which may remain in a combustion gas formed in the combustion chamber 30.

Figure 2:
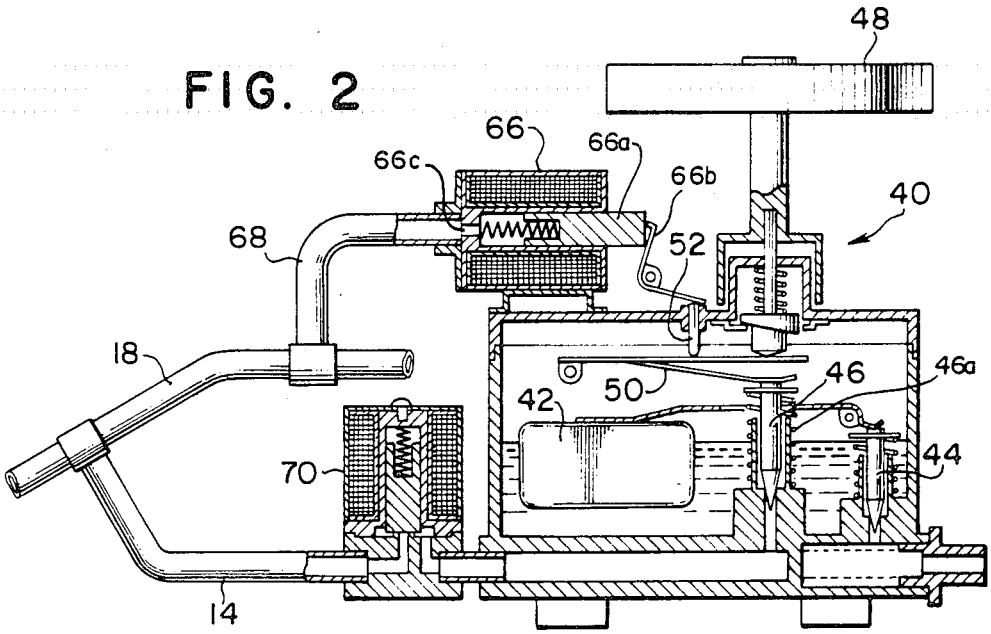
FIG. 2 is a vertical sectional view showing an example of a mechanism for controlling the flow rate of a fuel oil used in the oil burner shown in FIG. 1.

Further, the oil burner includes a mechanism 40 for controlling the flow rate of a fuel oil to be supplied to the vaporization and ignition means 12, as schematically shown in FIG. 1 and detailedly shown in FIG. 2. The fuel flow rate controlling mechanism 40 is disposed between the oil supply pipe 14 and the oil storage tank and is constructed in such a manner as known in the art. The controlling mechanism 40 includes a float 42, an oil level controlling valve 44 connected to the float so as to introduce a fuel oil in the mechanism 40 in cooperation with the float, a valve 46 for controlling the flow rate of a fuel oil to be supplied from the mechanism 40 through the oil supply pipe 14 to the means 12, a handle 48 for actuating the valve 46 through a cam means 50, and a shaft 52 for directly operating the cam means 50. The controlling mechanism 40 constructed as mentioned above is adapted to control the flow rate of a fuel oil by actuating the valve 46 through the cam means 50 by means of the handle 48 and supply a suitable amount of a fuel oil through the supply pipe 14 to the vaporization and ignition means 12.

Figure 3:
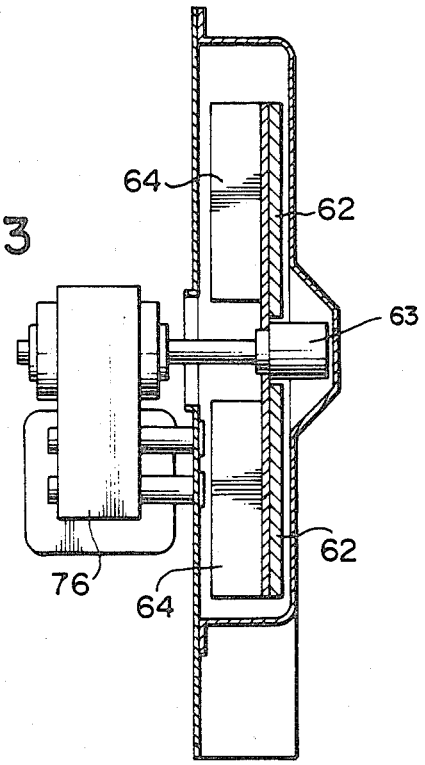
FIG. 3 is a partially sectional view showing an example of an air fan rotated by inertia force upon a power stoppage which forms a part of a safeguard mechanism against a power stoppage incorporated in the oil burner shown in FIG. 1.

The oil burner according to the present invention includes a safeguard mechanism against a power stoppage, which is generally indicated by reference numeral 54 in FIG. 1. The safeguard mechanism 54 includes an air damper 56 connected to an air supply passage 57 communicated with the air supply pipe 18 and the through-holes 26 of the diffusion and ignition chamber 20. The air damper 56 is actuated in cooperation with a mechanism for changing the flow rate of a fuel oil to be supplied to the vaporization and ignition means 12 which will be described hereinafter. Also, the air damper 56 has a solenoid 58 connected thereto which has a wiring of allowing the air damper 56 to be opened when the supply of an electric current to the oil burner is stopped. The safeguard mechanism also includes an air fan 60. The air fan 60 does not have a braking mechanism and is adapted to be rotated by inertia force when the supply of an electric current to the oil burner is stopped. In the embodiment illustrated, the application of inertia force to the air fan, as shown in FIG. 3, is accomplished by a weight 62 attached to each of blades 64 of the fan. Alternatively, inertia force may be applied to the air fan by weighing a base of the fan to which the blades are attached.

Reference numeral 66 designates a mechanism for changing the flow rate of a fuel oil which is schematically shown in FIG. 1 and detailedly shown in FIG. 2. In the embodiment illustrated, the flow rate changing mechanism 66 comprises a solenoid which is adapted to operate the shaft 52 of the flow rate controlling mechanism 40 to vary the flow rate of a fuel oil to be supplied to the vaporization and ignition means 12. Also, the mechanism 66 is constructed to be actuated in cooperation with the air damper 56 and has a ramification pipe 68 connected to the other end thereof which is communicated with the air supply pipe 18, so that the solenoid 66 returns to suck an air of the air supply pipe 18 in the ramification pipe 68 to carry out a fire extinguishing when the supply of an electric current to the oil burner is stopped.

Between the flow rate controlling mechanism 40 and the oil supply pipe 14, a solenoid valve mechanism 70 is disposed which has a wiring of allowing the supply of a fuel oil to the oil supply pipe 14 to be stopped when the supply of an electric current to the oil burner is stopped. The solenoid valve mechanism 70 may comprise only a solenoid valve. Alternatively, it may comprise a solenoid-operated pump acting as a solenoid valve in cooperation with the flow rate changing mechanism 66.

The manner of operation of the oil burner comprising the safeguard mechanism against a power stoppage illustrated in FIGS. 1 to 3 will now be explained with reference to FIG. 4 which is a circuit diagram used in the embodiment.

Figure 4:
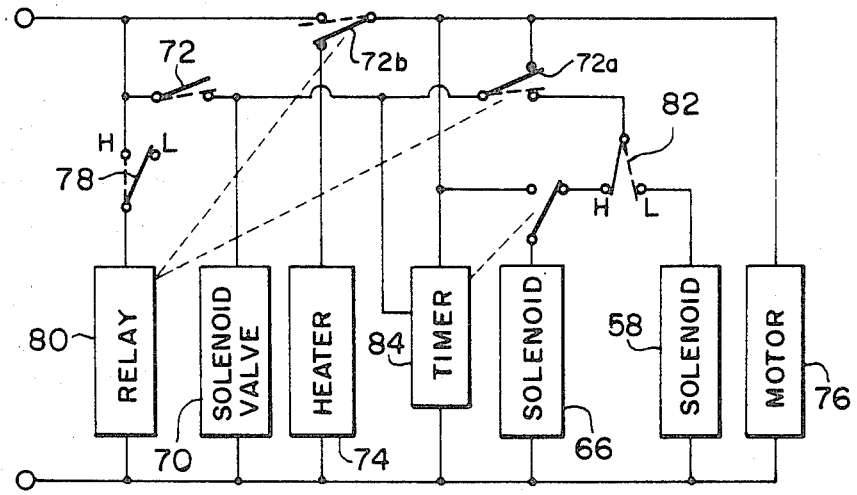
FIG. 4 is a schematic diagram of a circuit which may be employed in the oil burner of FIG. 1.

In FIG. 4, when a main switch 72 is closed, the solenoid valve mechanism 70 is actuated to allow a fuel oil to be supplied through the oil supply pipe 14 to the vaporization and ignition means 12, and an electric current is supplied to an ignition heater 74 provided in the vaporization and ignition means 12 and a motor 76 for operating the air fan 60 to carry out an ignition operation. When the vaporization and ignition means 12 is further increased in temperature, a thermostat 78 closes to the illustrated dashed line position and an electric current is supplied to a thermostat 78 to actuate a relay 80, to thereby interrupt the supply of an electric current to the ignition heater 74. Simultaneously, the flow rate changing mechanism 66 is actuated to retract the solenoid plunger 66*a*, thus allowing shaft 52 to be pushed upward and valve 46 to be opened by its spring 46*a* to increase the flow rate of a fuel, to thereby carry out the maximum combustion. The decrease in combustion can be carried out by changing over a switch 82 for changing the rate of combustion. More particularly, when the switch 82 is changed over as shown in FIG. 4, an electric current is supplied to the solenoid 58, which actuates to close the air damper 56 to allow a combustion air supplied to the oil burner to be decreased. Thus, switch 82 comprises a means for selectively disconnecting solenoid 58 and solenoid 66 from electrical power to provide flow rates of fuel and air into chamber 20 to achieve low and high rates of combustion. In a fire extinguishing operation, the main switch 72 is opened to interrupt the supply of an electric current to the solenoid valve mechanism 70 and the solenoid 58, to thereby stop the supply of a fuel oil to the vaporization and ignition means 12, so that the fire extinguishing may be carried out. In this instance, when the main switch 72 is opened, an electronic timer 84 is actuated to supply an electric current to the solenoid forming the flow rate changing mechanism 66, and then, the electronic timer 84 is opened in a few seconds to return the solenoid 66. This allows the solenoid 66 to suck an air within the air supply pipe 18 in the ramification pipe 68, to thereby rapidly carry out the fire extinguishing.

In the present invention constructed in the manner as mentioned above, the flow rate of an air introduced into the oil burner is controlled by the air damper 56 without changing the rotational speed of the motor 76 for actuating the air fan 60, therefore, the motor can be always rotated with a high speed during the combustion operation. In addition, the air fan 60 is applied thereto an inertia force by the weight 62 and does not have any braking mechanism, this resulting in the air fan 60 being capable of keeping a sufficient air supplying capacity just after a power stoppage. Also, the solenoid 58 connected to the air damper 56 has the wiring which allows the air damper 56 to be opened when the supply of an electric current to the oil burner is interrupted, thus, it is possible to supply a large amount of air through the air damper 56 to the vaporization and ignition means 12 when the supply of an electric current to the oil burner is reopened. The solenoid valve mechanism 70 has the wiring which allows the supply of a fuel oil to the oil supply pipe 14 to be stopped when the supply of an electric current to the oil burner is interrupted. Further, importantly, these components are adapted to be turned-off together at a power stoppage.

Thus, it will be noted that the present invention is capable of supplying to the oil burner a combustion air sufficient to accomplish the complete combustion of a combustible gas remaining in the vaporization and ignition means at a power stoppage, to thereby effectively prevent a soot and a smelly and toxic incomplete combustion product from being produced; because the present invention is adapted to stop the supply of a fuel oil to decrease a flame, open the air damper to decrease the flow resistance of an air and allow the air fan to keep an air supplying capacity due to inertia force at a power stoppage.

Thus, the oil burner having the safeguard mechanism against a power stoppage incorporated therein according to the present invention can be effectively used in the interior because only a complete combustion gas is always generated.

As many apparently widely different embodiments of this invention may be made without departing from the spirit and scope thereof, it is to be understood that the invention is not limited to the specific embodiment thereof except as defined in the appended claims.

What is claimed is:

1. A liquid fuel burner having a safeguard feature against interruption of electric power, said burner comprising:

an air supply pipe;

a liquid fuel supply pipe;

vaporization and ignition means connected to said air and fuel supply pipes for forming and igniting a combustible gas from air and liquid fuel supplied through said pipes;

circuit means for connecting said burner to a supply of electric current;

means for changing the flow rate of fuel through said fuel supply pipe to achieve different rates of combustion;

solenoid valve means connected to said fuel supply pipe and to said circuit means for stopping the flow of fuel therethrough upon interruption of a supply of electric current to said burner.

air damper means for controlling the flow of air to said air supply pipe;

solenoid means connected to said air damper means and to said circuit means for reducing air flow through said damper means upon connection of supply of electric current to said solenoid means and for increasing air flow through said damper means upon interruption of a supply of electric current to said solenoid means;

air fan means connected to said air damper means and said means for connecting for supplying a flow of air through said air supply pipe to said vaporization and ignition means; and weight means operatively connected to said air fan means for causing said air fan means to continue to rotate due to inertia force upon interruption of a supply of electric current to said burner;

whereby upon interruption of a supply of electric current, said solenoid valve means closes to stop the flow of fuel and said damper means opens to admit a continued flow of air to said vaporization and ignition means to complete combustion of fuel introduced prior to said interruption.

2. A burner according to claims 1, wherein said fuel supply pipe slopes downwardly to said vaporization and ignition means.

3. A burner according to claim 1, further comprising means for selectively disconnecting said solenoid means from said circuit means and for activating said means for changing, to provide flow rates of fuel and air to said vaporization and ignition means to achieve said different rates of combustion.

4. A burner according to claim 1, wherein said fuel supply pipe is connected to said air supply pipe and said air supply pipe slopes downwardly between the portion thereof connected to said fuel supply pipe and the end thereof connected to said vaporization and ignition means; further comprising means actuated by said means for changing the flow rate of fuel, for applying suction to said air supply pipe to aid in extinguishing fire upon interruption of a supply of electric current to said burner.

5. A burner according to claim 4, wherein, said means for changing the flow rate of fuel comprises a further solenoid having an interior bore and a plunger mounted to move within said interior bore upon actuation of said further solenoid; and said means for applying suction comprises a ramification pipe connected between said air supply pipe and said interior bore, whereby movement of said plunger creates suction in said ramification pipe.

6. A burner according to claim 5, further comprising means for controlling the flow of fuel to said fuel supply pipe at a portion of said oil supply pipe upstream of said solenoid valve means; and wherein said further solenoid of said means for changing the flow rate of fuel acts on said means for controlling so as to achieve said different rates of combustion.

7. An oil burner having a safeguard feature against interruption of electric power, said burning comprising:

a vaporization and ignition means for vaporizing liquid fuel supplied thereto, for forming a combustible gas from vaporized fuel and air supplied thereto and for igniting said combustible gas;

a liquid fuel supply pipe and an air supply pipe connected to said vaporization and ignition means, said fuel supply pipe being connected through said air supply pipe to said vaporization and ignition means, said air supply pipe being downwardly sloped between the portion thereof connected with said fuel supply pipe and the end portion thereof connected to said vaporization and ignition means;

circuit means for connecting said burner to a supply of electric power;

means for changing the flow rate of fuel supplied to said fuel supply pipe, said means for changing being connected to said fuel supply pipe;

means actuated by said means for changing the flow rate of fuel, for applying suction to said air supply pipe to aid in extinguishing fire upon interruption of a supply of electric current to said burner;

solenoid valve means connected to said fuel supply pipe and to said circuit means for stopping the flow of fuel therethrough upon interruption of a supply of electric current to said burner;

air damper means for controlling the flow of air to said air supply pipe;

solenoid means connected to said air damper means for reducing air flow through said damper mean upon connection of a supply of electric current to said solenoid means and for increasing air flow through said damper means upon interruption of a supply of electrical current to said solenoid means; and air flow means connected to said air damper means and to said circuit means for supplying a flow of air through said air supply pipe to said vaporization and ignition means; and weight means operatively connected to said air flow means for causing said air flow means to continue to rotate due to inertia force upon interruption of a supply of electric current to said burner;

whereby upon interruption of a supply of electric current, said solenoid valve means closes to stop the flow of fuel and said damper means opens to admit a continued flow of air to said vaporization and ignition means to complete combustion of fuel introduced prior to said interruption.

8. A burner according to claim 7, further comprising means for selectively disconnecting said solenoid means from said circuit means and for actuating said means for changing, to provide flow rates of fuel and air to said vaporization and ignition means to achieve said different rates of combustion.

9. A burner according to claim 8, wherein said means for changing the flow rate of fuel comprises a further solenoid having an interior bore and a plunger mounted to move within said interior bore upon activation of said further solenoid; and said means for applying suction comprises a ramification pipe connected between said air supply pipe and said interior bore, whereby movement of said plunger creates suction in said ramification pipe.

10. A burner according to claim 9, further comprising means for controlling the flow of fuel to said fuel supply pipe at a portion of said oil supply pipe upstream of said solenoid valve means; wherein said further solenoid of said means for changing acts on said means for controlling to achieve said different rates of combustion.

* * * * *